United States Patent [19]

Blajda et al.

[11] 4,040,359

[45] Aug. 9, 1977

[54] DISCARDING FRANGIBLE ROTATING BAND

[75] Inventors: Raymond S. Blajda, Parsippany; Robert W. Kantenwein, Landing; Gerald E. Gaughan, Dover, all of N.J.; John F. Sikra, Feasterville, Pa.

[73] Assignee: The United States of America as represented by the Secretary of the Army, Washington, D.C.

[21] Appl. No.: 686,610

[22] Filed: May 14, 1976

[51] Int. Cl.[2] ..... F42B 13/16

[52] U.S. Cl. ..... 102/93

[58] Field of Search ..... 102/93–94

[56] References Cited

U.S. PATENT DOCUMENTS

| | | | |
|---|---|---|---|
| 469,631 | 2/1892 | Driggs | 102/93 |
| 2,021,685 | 11/1935 | Fornaci | 102/93 |
| 3,148,472 | 9/1964 | Hegge et al. | 102/93 X |
| 3,769,912 | 11/1973 | Friend | 102/93 |
| 3,862,599 | 1/1975 | Olsen | 102/93 |
| 3,862,603 | 1/1975 | Kornblith | 102/93 |

*Primary Examiner*—Harold Tudor

*Attorney, Agent, or Firm*—Nathan Edelberg; A. Victor Erkkila; Max Yarmovsky

[57] ABSTRACT

A composite plastic-glass frangible rotating band, for a spin launched projectile, has epoxy filled annular stress risers embedded within its inner wall. The composite rotating band is designed to be resistant to compressive forces exerted thereon while in the gun barrel, but to fragmentize when suddenly subjected to tensile stress impressed thereon when exiting from the muzzle of a gun.

4 Claims, 1 Drawing Figure

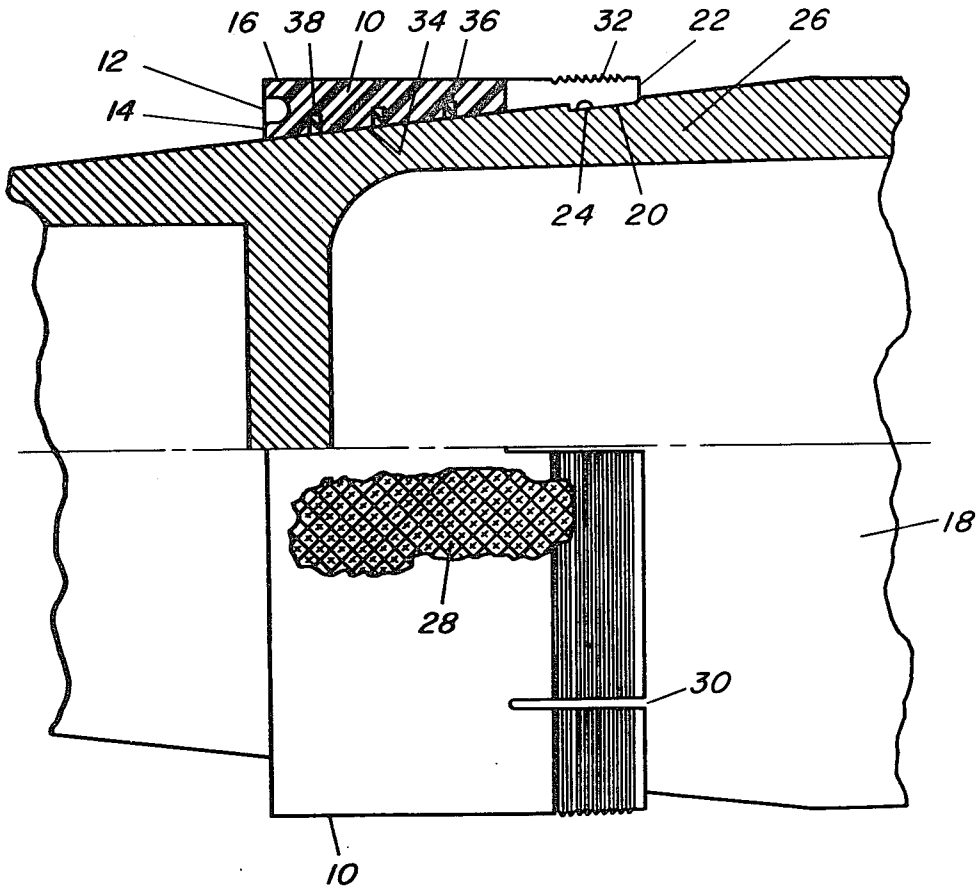
26
22
32
36
34
10
38
16
12
14
20
24
18
30
28
10

DISCARDING FRANGIBLE ROTATING BAND

GOVERNMENTAL INTEREST

The invention described herein may be manufactured, used and licensed by or for the Government for governmental purposes without the payment to us of any royalty thereon.

BACKGROUND OF THE INVENTION

Various means have been used in the prior art to give a projectile spin in order to improve the range and accuracy of a gun launched projectile. Rotating bands normally experience compressive loading conditions in the weapon due to the confinement of the rotating band between the gun tube and the projectile body. Upon exiting from the launch weapon under high spin, the rotating band is forced to suddenly experience tensile loading conditions. In prior art designs rotating band or sabot breakup was generally enhanced by putting stress risers, grooves, holes and undercuts in the rotating band wall. These prior art stress risers were successful in weakening the rotating band sufficiently to cause fragmentation outside of the gun barrel. However, a problem with these prior art devices was that the band frequently lost its structural integrity while being subjected to the compressive loading conditions in the gun tube. In the gun tube region a rotating band must remain whole in order to provide an obturating function and to impart spin to the round. In many instances structural failure of the rotating band while the projectile was being launched in the gun barrel was a cause for malfunction, loss of accuracy and loss of projectile range.

SUMMARY OF THE PRESENT INVENTION

The present invention relates to a discarding frangible rotating band for a spin stabilized projectile. The present device uitlizes a dual-material plastic-glass discarding type rotating band that attaches to the boattail end of a projectile and transmits the spin imparted by the rifling in a gun barrel to the projectile through a knurled interface surface. In the present invention annular stress risers are operatively disposed within the inner wall surface of the rotating band. The annular riser grooves, filled with an epoxy type material, serve as high stress break-up points for the rotating band when it exits from the muzzle of a launch weapon. The epoxy material used in the present invention was chosen to be strong in compression, but weak when subject to tensile loading. The composite material rotating band of the present device withstands the compressive loading conditions found in a gun tube during launch and fragments shortly after the spinning projectile, to which it is attached, exits from the gun muzzle.

BRIEF DESCRIPTION OF THE DRAWING

The drawing is a partial diametral longitudinal cross-sectional view of a non-metallic composite rotating band operatively positioned on the boattail end of a projectile.

DESCRIPTION OF THE PREFERRED EMBODIMENTS

Referring now to the drawing, a non-metallic composite plastic-glass cylindrically shaped rotating band 10 utilizes as its plastic base material an acetal copolymer resin. Acetal copolymer resin may be manufactured by the copolymerization of trioxane and small amounts of comonomer. A base resin suitable for use in the present invention is manufactured by Celanese Corp. of Summit, New Jersey under the trademark CELCON M90. To this base resin material hollow glass beads, having an average diameter of $2.2 \times 10^{-3}$ centimeters and a range of diameters which varies from $1 \times 10^{-3}$ centimeters to $6 \times 10^{-3}$ centimeters, are added to make a mixture which will enhance band break-up just outside the gun muzzle. It has been determined that an optimum filler concentration of glass beads in the base resin may vary from 7½% to 15% by volume. The rotating band 10 has an annular obturator undercut groove 12 in the band rear end 14. The purpose of undercut groove 12 is to provide an area for hot gases to exert an outwardly directed force against a flexible band lip 16. During launch the outward movement of band lip 16 creates a good gas seal between the lands and grooves of the rifling of the launch weapon, not shown, and the projectile 18 thus causing the projectile to be forcibly expelled from the weapon. The rotating band 10 is fixedly held to the projectile 18 by a press fit inwardly protruding band retaining lip 20 located on the interior wall of the band front end 22. Retaining lip 20 fits into an annular projectile band retaining groove 24 disposed circumjacent the periphery of the boattail end 26 of projectile 18. The band 10 is also held to the projectile by being press fit against a peripherally disposed knurled projectile surface 28. A plurality of equally spaced longitudinal band slots 30 are circumferentially positioned in the band forward end 22 to allow the forward end of the rotating band to deflect radially inward without danger of cracking when the projectile is being rammed into the forcing cone of a launch weapon. A plurality of peripheral concentric band grooves 32 are positioned on the band forward end outer wall surface for the purpose of weakening the rotating band material so that the band leading forward end 22 will engage the rifling of the launch weapon and help retain the projectile 18 in the aforementioned forcing cone when the weapon is elevated to its firing position. The rear portion of interior wall 34 of rotating band 10 has a plurality of annular stress undercuts, stress risers, or stress grooves 36 machined therein which are filled with an epoxy type, room temperature curing, resin 38 such as obtainable when using Hysol, Kit 1C, an adhesive epoxy resin manufactured by Hysol Div., 211 Franklin St., Olean, New York. The epoxy resin 38 can withstand a compressive stress ranging up to 9000–10,000 psi and a tensile shear stress up to 1,9000 psi as specified in MIL-A-8623 specification.

In operation rotating band 10 is press fit upon the boattail end 26 of a projectile 18 so that an interior wall band retaining lip 20 engages an annular circumferentially positioned projectile band retaining groove and the band interior wall 34 is press fit against the knurled projectile surface 28. When the projectile is fired from a launch weapon, not shown, hot gases generated by the propellant force flexible band lip 16 outward and create an obturating seal between the lands and grooves of the rifling of the launch weapon and the rotating band 10. When the projectile is within the launch weapon the rotating band 10 experiences compressive loading conditions which it is designed to withstand without loss of structural integrity. The rotating band 10 transmits to the knurled surface 28 of the projectile 18 the spin imparted by the rifling to the band 10. Upon exiting the launch weapon the band 10 and projectile 18 suddenly have the compressive stress forces released therefrom and a tensile force impressed thereon. The spin induced tensile force causes the composite rotating band 10, having epoxy filled stress risers 38 therein, to fail under tensile shear conditions and to fragmentize as soon as the rotating band 10 emerges from the muzzle of the launch weapon.

While there has been described and illustrated specific embodiments of the invention, it will be obvious that various changes, modifications and additions can be made herein without departing from the field of the invention which should be limited only by the scope of the appended claims.

Having thus fully described the invention, what is claimed as new and desired to be secured by Letters Patent of the United States is:

1. A discarding frangible rotating band for use on a spin launched projectile from a rifled gun which comprises:

a projectile having a boattail end with an annular, circumferentially disposed, knurled surface thereon, an annular projectile retaining groove positioned circumjacent the periphery of said boattail end and adjacent to said knurled surface;

composite rotating band means, press fit on said knurled surface and into said annular projectile retaining groove, for maintaining structural integrity when subjected to compressive forces of launch in order to provide an obturating seal to forcibly expel said projectile from said gun, for transmitting spin forces imparted by said rifled gun to said projectile, and for fragmentizing when exposed to tensile shear conditions as soon as said band means exits from the muzzle of said gun, which includes:

a cylindrically shaped band member being made of a mixture of an acetal copolymer resin and hollow glass beads, said band member having a front end which has an inwardly protruding retaining lip on the interior wall of said cylindrically shaped band member, a plurality of peripherally concentrically disposed band grooves located in the outer wall, a plurality of peripherally concentrically disposed band grooves located in the outer wall, a plurality of equally spaced longitudinal band slots disposed through said front end, a rear end having an annular obturator undercut groove therein, and a plurality of annular stress grooves rearwardly disposed in the interior wall of said cylindrically shaped band member; and epoxy resin means for filling said stress grooves to enable said rotating band to maintain structural shape while being exposed to compressive forces in said gun during launch and for helping said rotating band to fragmentize when said rotating band emerges from the muzzle of said gun.

2. A discarding frangible rotating band as recited in claim 1 wherein said mixture of acetal copolymer resin and hollow glass beads consists of 7½% to 15% hollow glass beads by volume.

3. A discarding frangible rotating band as recited in claim 1 wherein said mixture of an acetal copolymer resin and hollow glass beads consists of 7½% to 15% hollow glass beads, by volume, said beads having an average diameter of $2.2 \times 10^{-3}$ centimeters and ranging from $1 \times 10^{-3}$ centimeters to $6 \times 10^{-3}$ centimeters in diameter.

4. A discarding frangible rotating band as recited in claim 1 wherein said epoxy resin means comprises an adhesive, room temperature, curing resinous material capable of withstanding compressive stress ranging up to 9000–10,000 psi and a tensile shear stress up to 1,900 psi.

* * * * *